US005509263A

United States Patent [19]

Lossa

[11] Patent Number: 5,509,263

[45] Date of Patent: Apr. 23, 1996

[54] METHOD AND DEVICE FOR MANUFACTURING A TWISTED YARN

[75] Inventor: Ulrich Lossa, Krefeld, Germany

[73] Assignee: Palitex Project-Company GmbH, Krefeld, Germany

[21] Appl. No.: 310,696

[22] Filed: Sep. 16, 1994

[30] Foreign Application Priority Data

Sep. 18, 1993 [DE] Germany ..... 43 31 802.9

[51] Int. Cl.[6] ..... D01H 4/08

[52] U.S. Cl. ..... 57/409; 57/58.520; 57/413; 57/417

[58] Field of Search ..... 57/58.52, 58.7, 57/58.83, 400, 404, 406, 408, 409, 411, 413, 417

[56] References Cited

U.S. PATENT DOCUMENTS

| | | | |
|---|---|---|---|
| 3,757,507 | 9/1973 | Maxham | 57/409 X |
| 4,565,064 | 1/1986 | Iwasake et al. | 47/411 X |
| 4,729,214 | 3/1988 | Yngve et al. | 57/409 X |

FOREIGN PATENT DOCUMENTS

| | | | |
|---|---|---|---|
| 2354403 | 1/1978 | France . | |
| 78710 | 8/1969 | Germany . | |
| 88001 | 11/1971 | Germany . | |
| 1785366 | 3/1972 | Germany . | |
| 144679 | 10/1980 | Germany . | |
| 3721364 | 1/1989 | Germany . | |
| 4023397 | 1/1992 | Germany . | |
| 664168 | 12/1978 | Switzerland . | |
| 2066306 | 7/1981 | United Kingdom | 57/400 |

*Primary Examiner*—Joseph J. Hail, III
*Attorney, Agent, or Firm*—Robert W. Becker & Associates

[57] ABSTRACT

In a method and device for manufacturing a twisted yarn a spindle rotor having a hollow spindle axle with inlet and outlet and a yarn guide channel extending radially outwardly from the outlet is provided. The yarn exiting the yarn guide channel forms a yarn balloon. A stream of dissolved fiber material is fed axially through the spindle rotor into the space delimited by the yarn balloon and is divided into two partial streams. Each partial stream is guided first radially outwardly, then upwardly substantially parallel to the hollow spindle axle to a predetermined level, and subsequently radially inwardly to a respective spinning device arranged within the space delimited by the yarn balloon. A fiber is spun in each of the spinning devices, withdrawn, and guided axially downwardly. The fibers together are fed into the inlet of the hollow spindle axle to form a yarn. The yarn is guided through the hollow spindle axle and the yarn guide channel from where it exits and forms the yarn balloon. In the balloon the yarn is guided in a direction parallel to the upward direction of the partial streams to a centering element positioned on an extension of the axis of the hollow spindle axle such that the partial streams maintain a constant distance to the yarn in the yarn balloon.

5 Claims, 4 Drawing Sheets

METHOD AND DEVICE FOR MANUFACTURING A TWISTED YARN

BACKGROUND OF THE INVENTION

The present invention relates to a method for manufacturing a twisted yarn with a spindle rotor having a hollow spindle axle to which is connected a substantially radially outwardly extending yarn guide channel through which a yarn is passed which after exiting from the yarn guide channel forms a yarn balloon and is guided to a centering element that is positioned on an extension of the axis of the hollow spindle axle whereby into the space defined by the yarn balloon dissolved fiber material is introduced that is guided in the axial direction through the spindle rotor. The present invention also relates to a device for performing the inventive method having at least one spindle rotor that is rotatably supported on a spindle frame, which spindle rotor has a hollow spindle axle and connected thereto a yarn guide channel extending substantially radially outwardly, wherein a yarn exiting from the yarn guide channel forms a yarn balloon and is guided from the yarn balloon to a centering element positioned on an extension of the axis of the hollow spindle axle and is guided from there to a yarn winding device. The device further has a feeding device for introducing dissolved fiber material into the space defined by the yarn balloon which feeding device has an inlet line that is coaxially inserted into the spindle rotor.

Such a method and device are disclosed in German Patent 37 21 364. In the known method a flowable medium is introduced without disturbances into the space defined by the yarn balloon wherein the spindle rotor is provided with a plurality of guide vanes that are arranged in a spoke-like manner and wherein the yarn guide channel extends through one of these guide vanes. The flowable medium to be introduced into the space defined by the yarn balloon, in the case of a two-for-one twisting spindle, is conditioned air or a two-phase medium, for example, in the form of droplets suspended in air which are to impart a special effect on the yarn. It is also suggested that with this method fiber material can be introduced into the space defined by the yarn balloon.

It is an object of the present invention to provide a method for manufacturing a twisted yarn comprised of at least two yarn components of the aforementioned kind wherein the two-for-one spindle is supplied with dissolved fiber material and wherein the finished twisted yarn is removed from the two-for-one spindle.

In German Offenlegungsschrift 1 785 366 (1972) a spinning method is described which at the time of the disclosure was referred to as "element spinning". Pursuant to this method, fiber material is arranged to form a fiber band which is then formed to a rotating balloon wherein per revolution of the balloon at least two twists are imparted to the fiber band and the resulting yarn is removed from the spindle. The device for performing this known spinning method comprises a spinning chamber positioned on a spindle in which the fiber material is introduced through a fiber inlet tube that extends coaxially to the spindle axle and through a channel which extends radially to the spindle rotor. Within the spinning chamber a collector ring for the fiber material is provided which fiber material is formed to a roving. The fiber band exiting from the stretching device is guided through a channel which is positioned within the spindle axle wherein a first twist is imparted to the fiber band and exits from this channel in the radial direction to form a balloon rotating about the spinning chamber where a second twist is imparted to the fiber band.

The same principle has been used in German Offenlegungsschrfit 40 23 397 (1992) which discloses a method for spinning fibers to yarns as well as a spinning device for performing the method. According to this method, the fiber material is introduced to a spinning rotor and the yarn is removed in the counter-rotational direction so as to form a rotating arc about the spinning rotor. The device for performing this known spinning method comprises a spinning rotor supported on a two-for-one rotor which is rotatably supported in a stationary housing. The fiber exiting the spinning rotor is removed via a removal channel, positioned within the two-for-one twister and extending in an arc exterior to the spinning rotor, in order to be guided to the common axis of the spinning rotor and the two-for-one rotor is then guided upwardly through the drive device of the double wire rotor. This imparts a second twist to the yarn. The fiber material is introduced into the spinning rotor through an inlet channel within the two-for-one rotor whereby the inlet opening of the channel is symmetrical to the axis of the two-for-one rotor and the exit opening of the channel is eccentrically positioned to this axis.

The East German publication 88 001 shows a method for manufacturing a textile yarn which is comprised of at least two spun fibers. In this method two rotor spinning devices positioned atop one another are used whereby the fiber removal tube of the upper rotor spinning device is introduced into the rotor of the lower rotor spinning device and is arranged coaxially to the fiber removal tube of the lower rotor spinning device. The fiber produced within the upper rotor spinning device is combined with the fiber produced in the lower rotor spinning device and wound about it. A yarn balloon is not employed in this method.

SUMMARY OF THE INVENTION

The method for manufacturing a twisted yarn according to the present invention is primarily characterized by the steps of:

- Providing a spindle rotor having a hollow spindle axle with an inlet and an outlet and further having a yarn guide channel extending radially outwardly from the outlet, wherein a yarn exiting from the yarn guide channel forms a yarn balloon;
- Feeding a stream of dissolved fiber material axially through the spindle rotor into a space delimited by the yarn balloon;
- Dividing the stream of dissolved fiber material into at least two partial streams;
- Guiding each of the partial streams first radially outwardly, then in an upward direction substantially parallel to the hollow spindle axle to a predetermined level and subsequently radially inwardly to a respective spinning device arranged within the space delimited by the yarn balloon;
- Spinning a fiber in each spinning device;
- Withdrawing the fiber from each spinning device and guiding the fiber axially downwardly;
- Feeding the fibers together into the inlet of the hollow spindle axle to form a yarn; and
- Guiding the yarn through the hollow spindle axle and the yarn guide channel, wherein the yarn exiting from the yarn guide channel forms the yarn balloon and is guided in a direction parallel to the upward direction of the partial streams to a centering element positioned on an extension of an axis of the hollow spindle axle, and wherein the partial streams maintain a constant distance to the yarn in the yarn balloon.

The device for manufacturing a twisted yarn according to the method of the present invention is primarily characterized by:

At least one spindle rotor rotatably supported on a spindle rail;

The spindle rotor comprising a hollow spindle axle with an inlet and an outlet and further comprising a radially outwardly extending yarn guide channel connected to the outlet of the hollow spindle axle;

A centering element positioned on an extension of an axis of the hollow spindle axle;

A winding device positioned downstream of the centering element wherein a yarn guided through the hollow spindle axle and the yarn guide channel and exiting from the yarn guide channel forms a yarn balloon and is further guided through the centering element to the winding device;

A supply device having a supply line for feeding dissolved fiber material into a space delimited by the yarn balloon;

The spindle rotor having a feed line, wherein the supply line is connected coaxially to the feed line of the spindle rotor;

A yarn guiding element, fixedly connected to a free end of the yarn guide channel, for guiding the yarn to the centering element;

The feed line comprising at least two branch lines wherein each of the branch lines is comprised of a first section extending substantially radially outwardly, a second section fixedly connected to the spindle rotor and extending upwardly to a predetermined level, and a third section extending substantially radially inwardly, the second section connected between the first and third sections;

One spinning device for each one of the branch lines, wherein the third section opens into the spinning device;

The spinning devices arranged atop one another; and

The spinning devices having a fiber removal tube and the fiber removal tubes arranged coaxially relative to one another and the hollow spindle axle.

Preferably, the inventive device further comprises a protective pot comprising a cylindrical wall and a cover. The spindle rotor in this embodiment forms the bottom of the protective pot. The centering element is a guide eye provided at the cover. The free end of the yarn guide channel is positioned directly in front of the cylindrical wall, with the cylindrical wall forming the yarn guiding element. Advantageously, the second section of the branch lines is located within the cylindrical wall and the spinning devices are arranged within the protective pot.

In yet another embodiment of the present invention, the device further comprises an annular channel connected to the underside of the spindle rotor and communicating with the interior of the protective pot. A vacuum-generating device is connected to the annular channel.

Expediently, the spinning devices are rotor spinning devices and each rotary spinning device comprises a rotor into which the third section is guided, a stator on which the rotor is supported, a drive device for driving the rotor, wherein the drive device is connected to the stator, and a securing device for securing the stator in a stationary position in a contact-free manner. The fiber removal tube is preferably fixedly connected to the stator and extends coaxially through the rotor and the stator.

In conventional twisting methods supply spools are arranged within the space defined by the yarn balloon above the spindle rotor which supply spools provide the fiber material to be twisted into a yarn. When it is desired to manufacture a twisted yarn directly from dissolved fiber material, a first problem to be solved is that the dissolved fiber material must be introduced into the space defined by the yarn balloon. This object is in principle solved for other purposes by the aforementioned German Patent 37 21 364. Based on the disclosure of this prior art reference the principle of the invention is that fiber material introduced into the twisting spindle is directly used for the manufacture of the twisted yarn made up of at least two yarn components and to introduce this fiber material such that, on the one hand, the yarn balloon is not disturbed and, on the other hand, enough space is provided in order to accommodate the multiple spinning devices within the space defined by the yarn balloon. The fiber material is to be supplied to the spinning devices in separate fiber material streams, and the removed fibers together are to be guided through the hollow spindle axle and the yarn balloon. In order to provide enough space and to safely prevent a disturbance of the yarn balloon, according to the present invention partial streams of the dissolved fiber material are guided substantially within the envelope of the yarn balloon formed by the rotating yarn in an upward direction whereby the partial streams rotate at the same rotational velocity as the yarn and are always spaced at the same distance to the yarn. In this manner it is possible to supply each partial stream to a predetermined level or height within the twisting spindle from where it can then be introduced radially inwardly to the respective spinning device.

With such a guide path sufficient space is provided so that within the space defined by the yarn balloon the conventional spinning devices can be accommodated, for example, rotor spinning devices including their drive devices and the required devices for power supply and fiber removal.

The inventive device can be embodied such that the removed fibers are guided into a yarn guide tube extending from the yarn guide channel that is connected to the spindle rotor and rotates with it and guides the yarn to the centering element. The yarn is then guided through this yarn guide tube to the centering element while the partial streams of dissolved fiber material are guided in branch lines upwardly. The branch lines are also connected to the spindle rotor. They are in the form of tubes that rotate with the spindle rotor and, in analogy to the yarn guide tube, are guided upwardly spaced at a predetermined angular distances to the yarn guide tube.

In an especially advantageous embodiment of the inventive device the balloon limiter surrounding the twisting spindle is fixedly connected to the spindle rotor so that it rotates with the spindle rotor. The spindle rotor thus forms the bottom of a closed protective pot which has a cylindrical wall and is closed at its upper end with a cover in which the centering element is arranged. In this embodiment the balloon formed by the upwardly guided twisted yarn contacts the inner side of the rotating balloon limiter and the partial streams of fiber material are guided upwardly within the cylindrical wall in branch lines arranged therein to the spinning devices. As will be described in detail infra with the aid of one embodiment, it is expedient to generate a vacuum within the protective pot formed by the spindle rotor, the rotating balloon limiter (the cylindrical wall of the protective pot), and the cover.

BRIEF DESCRIPTION OF THE DRAWINGS

The objects and advantages of the present invention will appear more clearly from the following specification in conjunction with the accompanying drawings, in which.

DESCRIPTION OF PREFERRED EMBODIMENTS

Figure 1:
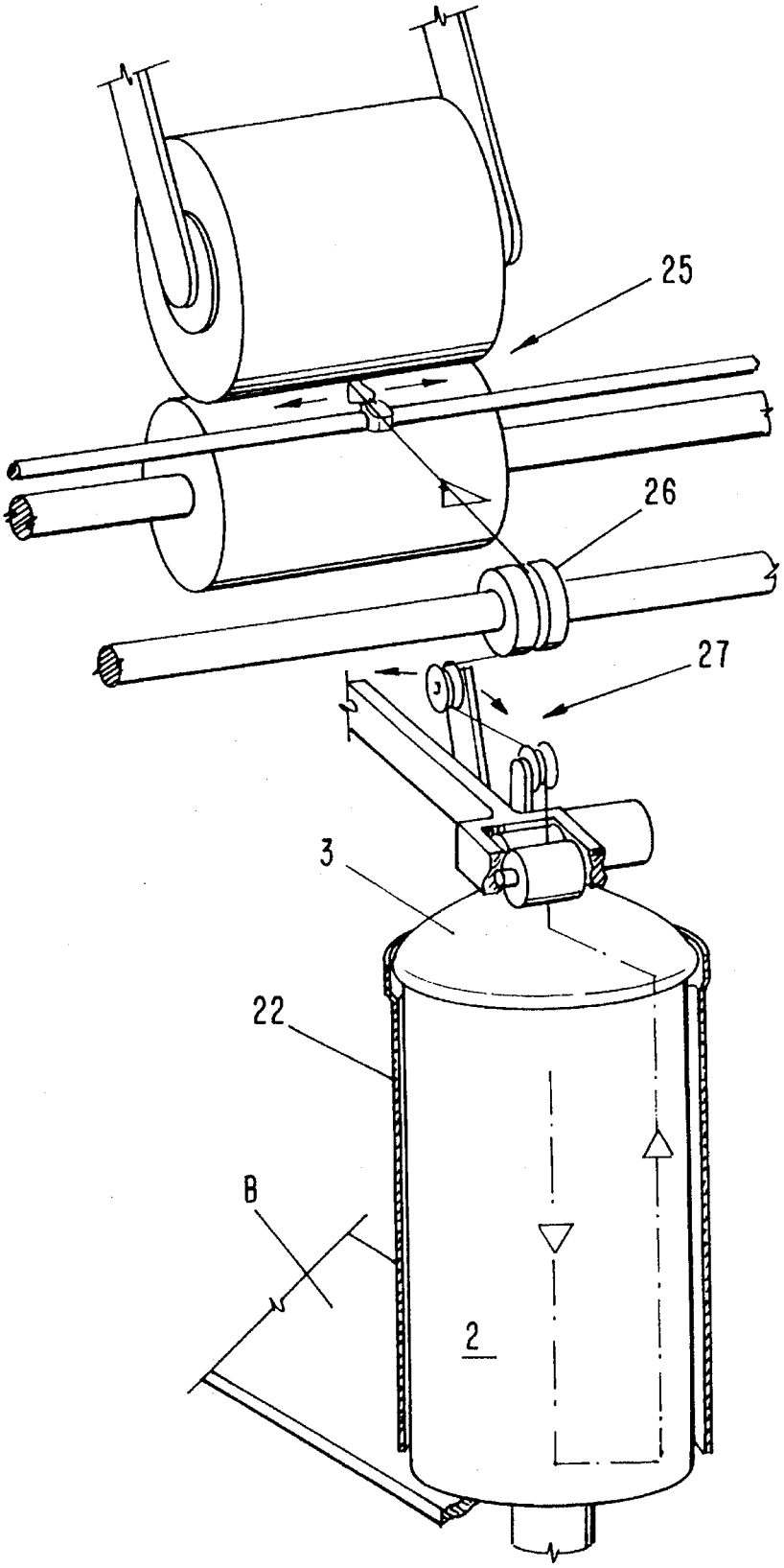
FIG. 1 is a perspective view of a device for generating a twisted yarn from two yarn components made of dissolved fiber material.

The present invention will now be described in detail with the aid of several specific embodiments utilizing FIGS. 1 through 3.

The device represented in the drawings has a spindle rotor 1 which with its central hollow rotor shaft 1.1 is rotatably supported with a bearing 4 at a machine frame, for example, in a spindle rail B. At the lower end of the hollow spindle shaft 1.1 a whorl 5 is provided, as is conventional with two-for-one twisting spindles. A drive belt engages the whorl 5. Of course, any other drive motor can be arranged at this location.

The spindle rotor 1 forms the bottom of a closed protective pot with a cylindrical wall 2 (balloon limiter) which with its lower portion is fixedly connected to the spindle rotor 1 and a cover 3 which is connected via seals 3.2 to the upper end of the cylindrical wall 2. At the highest point of the cover 3 on the central axis of the protective pot a centering element in the form of a yarn guide eye 3.1 is provided.

The spindle rotor 1 at its upper end is provided with a central hollow spindle axle 1.2 to which is connected via a first guide eye 1.3 the yarn guide channel 1.4 which extends radially outwardly within the spindle rotor 1. The radially outer free end or exit opening of the yarn guide channel 1.4 is provided with a second guide eye 1.5 and is positioned directly in front of the inner surface of the cylindrical wall 2.

The stator 7 of a first rotor spinning device is supported via a rotary bearing 14 on the spindle rotor 1, on which stator 7 the rotor 8 is supported via a rotary bearing 15. A support sleeve 9 is supported on the stator 7 via a bearing 16. At the upper end of the bearing sleeve 9 a rotary bearing 17 supports the stator 10 of a second rotary spinning device. With a rotary bearing 18 the rotor 11 of the rotor spinning device is supported at the stator 10. The two stators 7 and 10 are fixed in a stationary position relative to the machine frame or spindle rail B by permanent magnet securing devices 12, 13 in a contact-free manner. The first rotor spinning device 7, 8 comprises an electrical drive motor 19 positioned between the stator 7 and the rotor 8, while the second rotary spinning device 10, 11 is provided with a corresponding electrical drive motor 20. Electrical power is supplied through the spindle rotor 1 via a slipring contact 21.1 and line 21.2 extending within the stator 7 as well as via a slippering contact 21.3 via a line 21.4 extending within the bearing sleeve 9. A further slipring contact 21.5 with line 21.6 extending within the stator 10 is provided. The first slippering contact 21.1 at the spindle rotor 1 is supplied with electrical power via non-represented electrical supply lines and optionally a further slipring contact at the central rotor shaft 1.1. Of course, the supply and transport of electrical power between the rotary parts can also be performed by inductive transmission with a high-frequency carrier. It is also possible to use dynamometric energy conversion for generating and supplying the required electrical power.

The rotor spinning device 10, 11 supports furthermore a fiber removal tube 10.1 extending coaxially to the hollow spindle axle 1.2 which is connected to the stator 10 and the upper end of which extends into the rotor 11 while the lower end is guided into the rotor 8 of the other rotor spinning device 7, 8. The fiber removal tube 10.1 extends coaxially to the bearing sleeve 9. The fiber removal tube 10.1 also extends coaxially to the fiber removal tube 7.1 of the other rotary spinning device 7, 8 which fiber removal tube 7.1 is connected to the stator 7 and has an upper end extending into the rotor 8 and a lower end positioned directly in front of the inlet of the hollow spindle axle 1.2.

Figures 4, 4A:
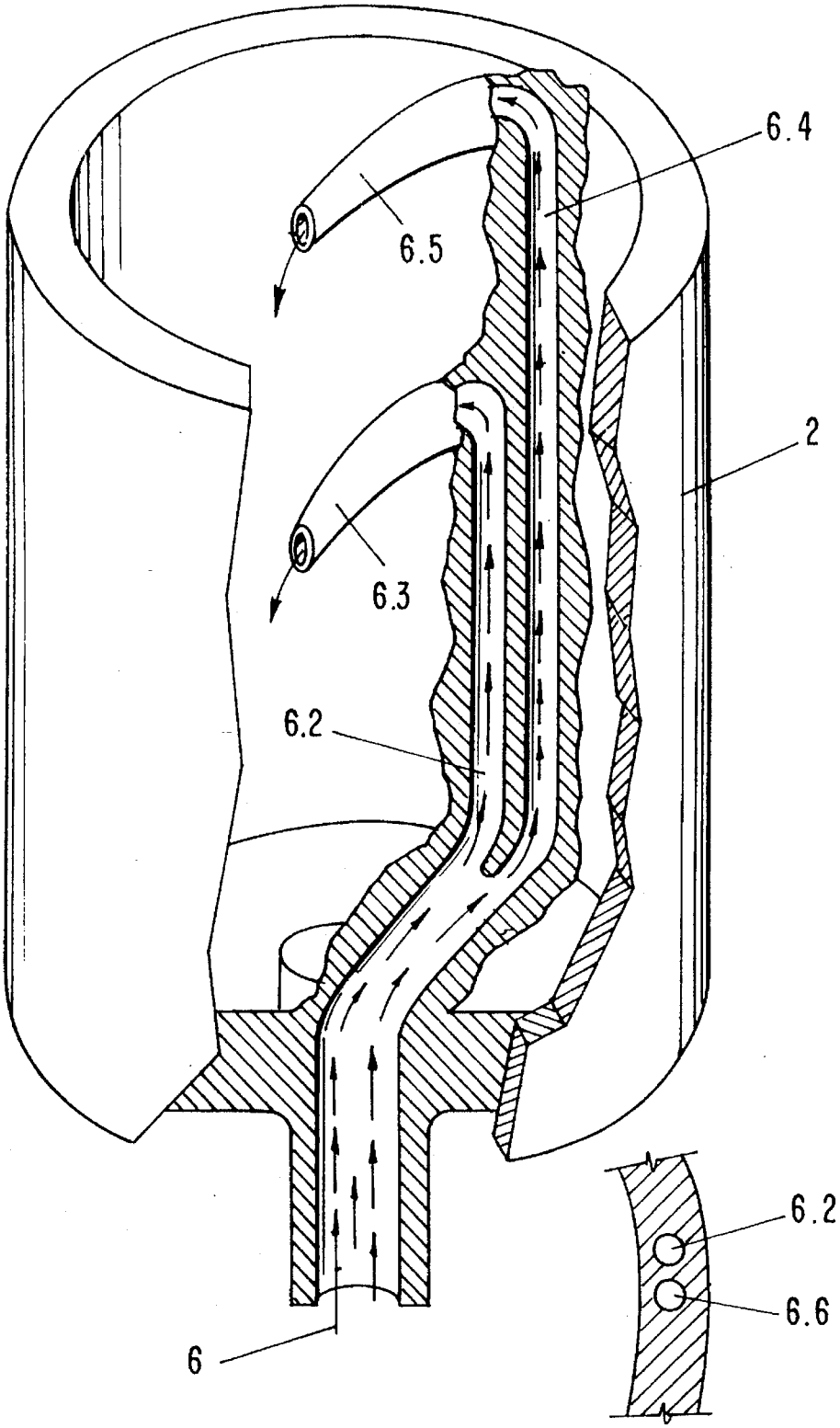
FIG. 4 shows the two branch lines of the feed line.
FIG. 4*a* shows a cross-section of the cylindrical wall with the two branch lines.

The supply of dissolved fiber material to the spindle rotor 1 is carried out via a feed line 6 extending axially through the central hollow rotor shaft 1.1 which feed line 6 is divided within the spindle rotor 1 (FIGS. 4, 4*a*) into two branch lines 6.2, 6.4 that extend initially radially outwardly. The first branch line is represented in FIG. 2 and is comprised of a first radially outwardly extending section 6.1 to which is connected an upwardly extending section 6.2 that terminates at a predetermined height above the rotor 8 of the lower rotor spinning device 7, 8. Connected to the second section 6.2 is a radially inwardly extending section 6.3 that ends in the rotor 8.

Figure 2:
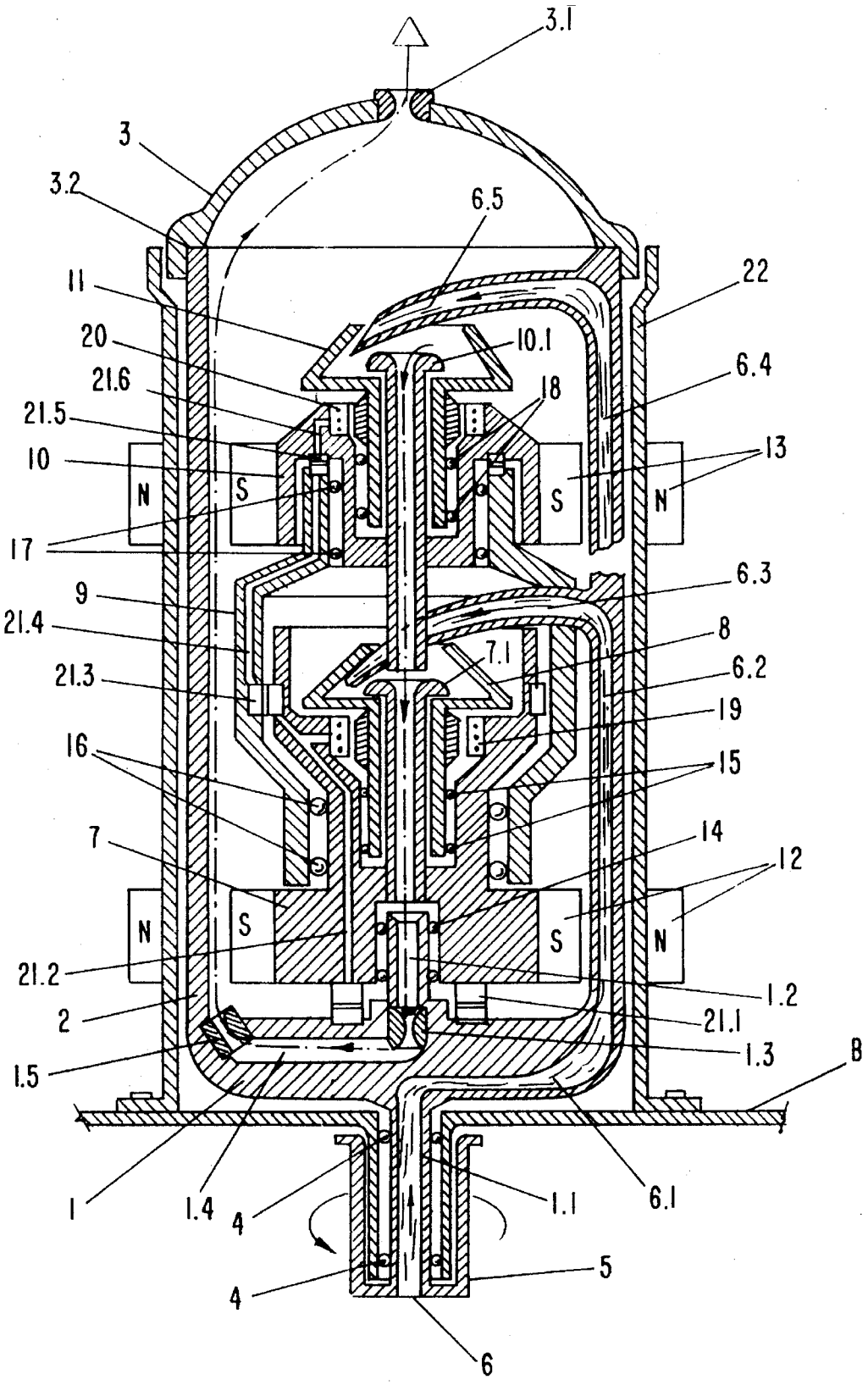
FIG. 2 is a vertical section of a portion of the device according to FIG. 1.

The lower section of the other branch line extends also radially outwardly within the spindle rotor 1 and with its second section 6.4 (FIG. 4) of which only the upper portion is partially represented in FIG. 2, extends within the cylindrical wall 2 upwardly to the predetermined height above the spindle rotor 11 of the upper rotor spinning device 10, 11. At this location the radially inwardly extending section 6.5 is provided that extends into the rotor 11 from the top.

In order to facilitate the drawings the two branch lines 6.2 and 6.4 in FIG. 2 are represented such that they extend upwardly at the same side within the cylindrical wall 2. In a practical embodiment, however, the first sections of the branch lines within the spindle rotor 1 are guided in different direction radially outwardly so that the second sections of the branch lines in the circumferential direction of the spindle rotor 1 are displaced relative to one another by a predetermined angular distance. This angle, for example, can be 180°. In this case it is expedient that the yarn guide channel 1.4 represented in FIG. 1 in the plane of the drawing is positioned, for example, at an angle of 90° relative to the branch lines so that its exit opening (1.5) in the circumferential direction of the spindle rotor 1 is staggered by 90° relative to the second sections 6.2 and 6.4 of the branch lines.

Figure 3:
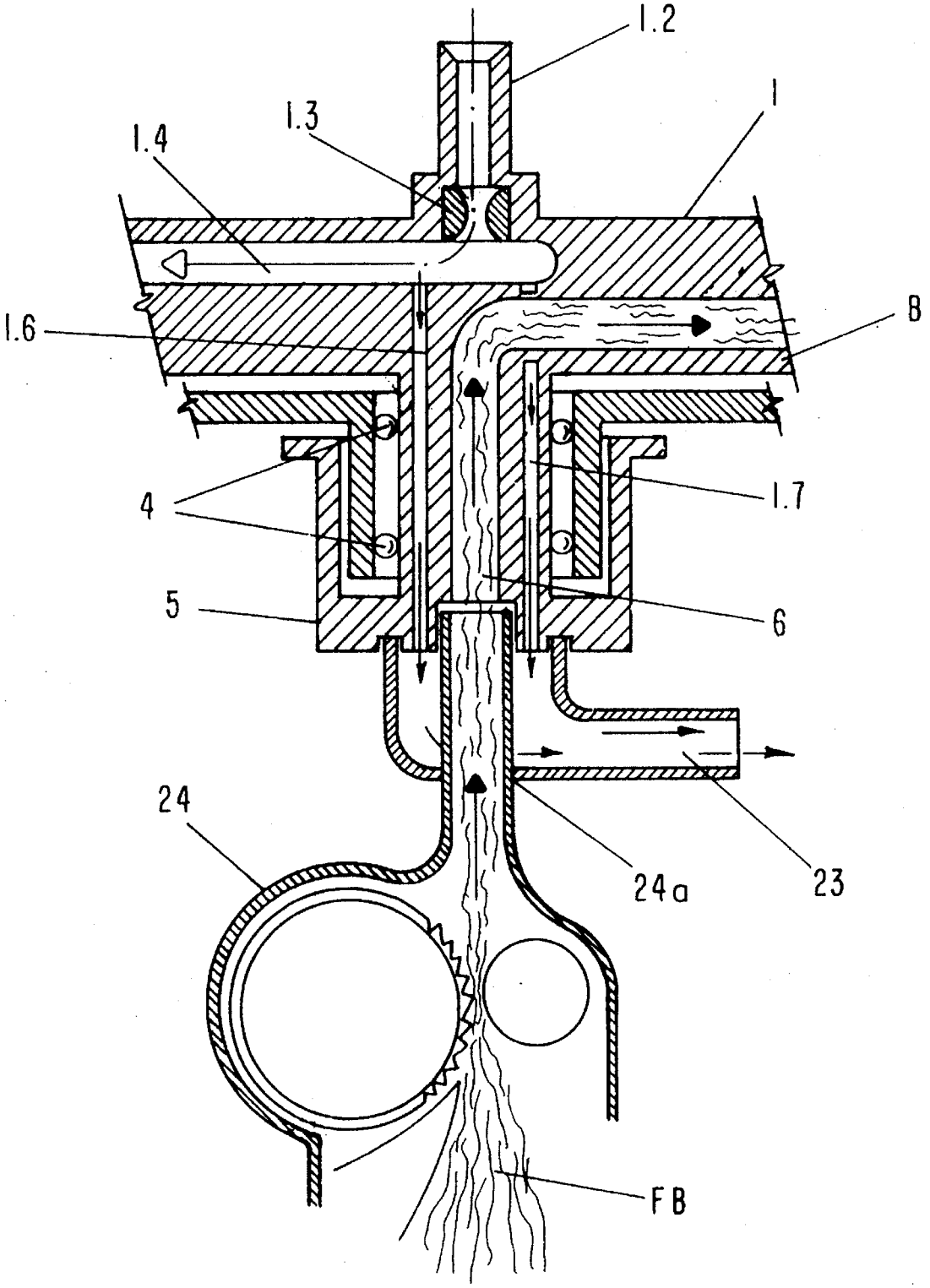
FIG. 3 shows in a vertical part section the lower portion of the device according to FIG. 2 in detail.

As can be seen in FIG. 3, a conventional supply device 24 (a so-called opening roller) for dissolving (separating) and supplying fiber material is connected via supply line 24*a* to the external end of the feed line 6 for the fiber material. Such devices are well-known in the art and need not be explained in any detail in this context. In order to be able to provide a vacuum within the interior of the protective pot formed by the spindle rotor 1, the cylindrical wall 2, and the cover 3 a vacuum line 1.6 is guided through the wall of the central hollow spindle axle 1.2 and the whorl 5. The vacuum line 1.6 opens at an end face of the whorl 5 and is connected via a connecting element 23 to a non-represented vacuum pump. The inner end of the vacuum line 1.6 in the shown embodiment is connected to the yarn guide channel 1.4. Of course, the connection of the vacuum line 1.6 to the interior of the protective pot can also be provided at a different location. Since the entire interior of the protective pot with the exception of the yarn guide eye 3.1 within the cover 3 is closed, the resulting vacuum also acts within the area of the rotor spinning devices 7, 8; 10, 11 to thereby convey the dissolved fiber material supplied via the two branch lines into the area of the rotor spinning devices.

As can be seen in FIGS. 1 and 2 the entire device is surrounded by a protective cylinder 22 for safety and energy-conserving reasons which protective cylinder 22 is fixedly connected to the machine frame or spindle rail B. Above the device a winding device 25 of conventional design is arranged to which is supplied the yarn exiting from the yarn guide eye 3.1 via a removing device 27 for length compensation and a guide pulley 26.

In the following, the function of the device represented in FIGS. 1 to 3 will be explained. The fiber material supplied via the feed line 6 is conveyed due to the vacuum within the interior of the protective pot via the branch line 6.1, 6.2, 6.3 and 6.4, 6.5 to the rotors 8 and 11 of the rotor spinning devices in which a spun fiber is produced, respectively. The spun fiber of the upper rotor spinning device 10, 11 is removed via the fiber removing tube 10.1 and guided through the fiber removing tube 7.1 to the inlet of the hollow spindle axle 1.2. In the same manner the spun fiber generated within the rotor 8 is guided through the fiber removal tube 7.1 together with the other spun fiber from the upper rotor spinning device 10, 11 into the hollow spindle axle 1.2. Both spun fibers thus are subjected to an entwining process and are conveyed together into the twisting zone. During further travel through the inventive device the twisted yarn passes through the yarn guide channel 1.4 and exits through the guide eye 1.5 to form a yarn balloon which is supported at the inner surface of the cylindrical wall 2 (balloon limiter). The yarn is removed through the yarn guide eye 3.1 at the cover 3 and guided to the winding device 25. The two rotors 8 and 11 can operate in the opposite rotational direction or in the same rotational direction as the spindle rotor 1.

The rotating rotors 8 and 10 of the rotor spinning devices are supported on the stators 7 and 10, respectively, which are held in a stationary position by the permanent magnet securing devices 12 and 13. The third section 6.3 of the lower branch liner 6 is guided through the bearing sleeve 9 so that the sleeve 9 rotates together with the spindle rotor 1 relative to the stators 7 and 10.

The present invention is, of course, in no way restricted to the specific disclosure of the specification and drawings, but also encompasses any modifications within the scope of the appended claims.

What I claim is:

1. A method for manufacturing a twisted yarn, said method comprising the steps of:

providing a spindle rotor having a hollow spindle axle with an inlet and an outlet and further having a yarn guide channel extending radially outwardly from said outlet, wherein a yarn exiting from said yarn guide channel forms a yarn balloon;

feeding a stream of dissolved fiber material axially through said spindle rotor into a space delimited by the yarn balloon;

dividing said stream of dissolved fiber material into at least two partial streams;

guiding each of said partial streams first radially outwardly, then in an upward direction substantially parallel to said hollow spindle axle to a predetermined level and subsequently radially inwardly to a respective spinning device arranged within said space delimited by said yarn balloon;

spinning a fiber in each said spinning device;

withdrawing said fiber from each said spinning device and guiding said fibers axially downwardly; and feeding said fibers together into said inlet of said hollow spindle axle to form a yarn; and guiding said yarn through said hollow spindle axle and said yarn guide channel, wherein said yarn exiting from said yarn guide channel forms said yarn balloon and is guided in a direction parallel said upward direction of said partial streams to a centering element positioned on an extension of an axis of said hollow spindle axle, and wherein said partial streams maintain a constant distance to said yarn in said yarn balloon.

2. A device for manufacturing a twisted yarn wherein a stream of dissolved fiber material is fed axially through a spindle rotor into a space delimited by the yarn balloon formed by the manufactured yarn, wherein said stream of dissolved fiber material is divided into at least two partial streams that are each guided first radially outwardly, then in an upward direction substantially parallel to said hollow spindle axle to a predetermined level and subsequently radially inwardly to a respective spinning device arranged within the space delimited by the yarn balloon, wherein a fiber is spun in each spinning device, withdrawn therefrom and guided axially downwardly so as to feed the fibers together into an inlet of said hollow spindle axle to form a yarn, wherein said yarn is guided through said hollow spindle axle and a yarn guide channel and, when exiting from said yarn guide channel, forms said yarn balloon and is guided upwardly to a centering outlet positioned on an extension of an axis of said hollow spindle axle; said device comprising:

at least one spindle rotor rotatably support on a spindle rail;

said spindle rotor comprising a hollow spindle axle with an inlet and an outlet and further comprising a radially outwardly extending yarn guide channel connected to said outlet of said hollow spindle axle;

a centering element positioned on an extension of an axis of said hollow spindle axle;

a winding device positioned downstream of said centering element, wherein a yarn guided through said hollow spindle axle and said yarn guide channel and exiting from said yarn guide channel forms a yarn balloon and is further guided through said centering element to said winding device;

a supply device having a supply line for feeding dissolved fiber material into a space delimited by said yarn balloon;

said spindle rotor having a feed line, wherein said supply line is connected coaxially to said feed line of said spindle rotor;

a yarn guiding element, fixedly connected to a free end of said yarn guide channel, for guiding said yarn to said centering element;

said feed line comprising at least two branch lines, wherein each of said branch lines is comprised of a first section extending substantially radially outwardly, a second section fixedly connected to said spindle rotor and extending upwardly to a predetermined level, and a third section extending substantially radially inwardly, said second section connected between said first and said third sections;

one spinning device for each one of said branch lines, wherein said third section opens into said spinning device;

said spinning devices arranged atop one another; and said spinning devices having a fiber removal tube and said fiber removal tubes are arranged coaxially relative to one another and said hollow spindle axle.

3. A device according to claim 2, further comprising a protective pot comprising a cylindrical wall and a cover, wherein:

said spindle rotor forms a bottom of said protective pot;

said centering element is a guide eye provided at said cover;

said free end of said yarn guide channel is positioned directly in front of said cylindrical wall, with said cylindrical wall forming said yarn guiding element;

said second sections of said branch lines located within said cylindrical wall; and said spinning devices arranged within said protective pot.

4. A device according to claim 3, further comprising:

an annular channel connected to an underside of said spindle rotor and communicating with the interior of said protective pot; and a vacuum-generating device connected to said annular channel.

5. A device according to claim 2, wherein said spinning devices are rotor spinning devices, each rotor spinning device comprising: a rotor into which said third section is guided; a stator on which said rotor is supported; a drive device for driving said rotor, said drive device connected to said stator; and a securing device for securing said stator in a stationary position in a contact-free manner, wherein said fiber removal tube is fixedly connected to said stator and extends coaxially through said rotor and said stator.

* * * * *